US010072833B2

(12) United States Patent
Ng et al.

(10) Patent No.: US 10,072,833 B2
(45) Date of Patent: Sep. 11, 2018

(54) LIGHT APPARATUS WITH CONTROL BOARD THERMALLY INSULATED FROM LIGHT SOURCE

(71) Applicant: OSRAM Opto Semiconductors GmbH, Regensburg (DE)

(72) Inventors: Kok Eng Ng, Penang (MY); Choo Kean Lim, Penang (MY); Eu Liong Ong, Penang (MY); Boon Liang Yap, Penang (MY)

(73) Assignee: OSRAM OPTO SEMICONDUCTORS GMBH, Regensburg (DE)

( * ) Notice: Subject to any disclaimer, the term of this patent is extended or adjusted under 35 U.S.C. 154(b) by 238 days.

(21) Appl. No.: 14/911,765

(22) PCT Filed: Aug. 13, 2013

(86) PCT No.: PCT/EP2013/066870

§ 371 (c)(1),
(2) Date: Feb. 12, 2016

(87) PCT Pub. No.: WO2015/022015

PCT Pub. Date: Feb. 19, 2015

(65) Prior Publication Data

US 2016/0186976 A1 Jun. 30, 2016

(51) Int. Cl.

| | |
|---|---|
| ***F21V 23/00*** | (2015.01) |
| ***F21V 29/15*** | (2015.01) |
| ***F21V 17/10*** | (2006.01) |
| ***F21V 29/70*** | (2015.01) |
| *F21Y 115/10* | (2016.01) |

(52) U.S. Cl.
CPC ..... *F21V 29/15* (2015.01); *F21V 17/101* (2013.01); *F21V 29/70* (2015.01); *F21Y 2115/10* (2016.08)

(58) Field of Classification Search
CPC .... F21V 19/001; F21V 19/003; F21V 19/005; F21V 23/003; F21V 23/004; F21V 23/006; F21V 23/007; F21S 8/03
See application file for complete search history.

(56) References Cited

U.S. PATENT DOCUMENTS

| | | | | |
|---|---|---|---|---|
| 8,414,178 | B2 * | 4/2013 | Alexander | F21V 19/001 362/655 |
| 8,425,082 | B2 * | 4/2013 | Wang | F21S 8/04 362/249.02 |
| 8,439,527 | B2 * | 5/2013 | Takahasi | F21S 8/026 313/318.08 |
| 8,641,246 | B2 * | 2/2014 | Takahara | F21V 23/006 362/362 |
| 9,103,531 | B2 * | 8/2015 | De Anna | F21V 23/006 |

(Continued)

FOREIGN PATENT DOCUMENTS

| | | | |
|---|---|---|---|
| DE | 102010043220 | A1 | 5/2012 |
| EP | 2469161 | A1 | 6/2012 |
| EP | 2623857 | A1 | 8/2013 |

*Primary Examiner* — Ismael Negron
(74) *Attorney, Agent, or Firm* — Slater Matsil, LLP

(57) ABSTRACT

A light apparatus includes a first carrier with an optoelectronic component for generating electromagnetic radiation, a second carrier with at least one electronic component for controlling the optoelectronic component, and a thermally insulating layer arranged between, and attached to, the first and second carriers.

19 Claims, 2 Drawing Sheets

(56) References Cited

U.S. PATENT DOCUMENTS

| | | | | |
|---|---|---|---|---|
| 2009/0268470 | A1* | 10/2009 | Okimura | F21K 9/20 362/311.02 |
| 2012/0049736 | A1* | 3/2012 | Shimizu | F21V 19/0005 315/53 |
| 2012/0140442 | A1* | 6/2012 | Woo | F21V 7/04 362/95 |
| 2013/0146937 | A1* | 6/2013 | Omura | F21V 23/00 257/99 |
| 2013/0223083 | A1* | 8/2013 | Kimiya | F21V 29/2206 362/382 |
| 2013/0265779 | A1* | 10/2013 | Scordino | F21V 19/001 362/368 |
| 2015/0300574 | A1* | 10/2015 | Preuschl | H01R 12/714 362/382 |
| 2017/0254511 | A1* | 9/2017 | Matsubayashi | F21V 13/04 |

* cited by examiner

LIGHT APPARATUS WITH CONTROL BOARD THERMALLY INSULATED FROM LIGHT SOURCE

This patent application is a national phase filing under section 371 of PCT/EP2013/066870, filed Aug. 13, 2013, which is incorporated herein by reference in its entirety.

TECHNICAL FIELD

The invention refers to a light apparatus having a first carrier with at least one electronic component.

BACKGROUND

DE 10 2010 043 220 A1 discloses a light apparatus having a first carrier with at least one electronic component for controlling an optoelectronic component. The apparatus comprises a second carrier with an optoelectronic component for generating light. The first and the second carrier are directly attached to each other, wherein the second carrier lies on the first carrier providing a thermal conducting connection between the first and the second carrier.

SUMMARY

An improved light apparatus with an improved function of the electronic component is provided.

The light apparatus has the advantage that the electronic component functions more precisely. This improvement is attained by providing an insulating layer that thermally insulates the first carrier from the second carrier and that mechanically connects the first and the second carrier. The optoelectronic component is arranged on the second carrier and generates heat that raises the temperature of the second carrier. Since the second carrier does not directly contact the first carrier, there is at least a reduced heat transport to the first carrier. The thermal insulation is attained by the thermally insulating layer that is arranged between the first and the second carrier. During the operation mode of the optoelectronic component, the temperature of the electronic component of the first carrier decreases by more than 10% compared to the state of the art. Experiments have shown that without a thermal insulating layer, the temperature of the electronic component may rise to a range of about 85° C. at an ambient temperature of about 25° C. This means, for example, that a resistor value of an electronic component may drop by about 25%. If a diode is arranged as an electronic component, the performance of the diode may be reduced by about 55%. The insulating layer reduces or solves these problems.

In a further embodiment, the insulating layer has the shape of a ring. The ring shape of the insulating layer has the advantage that the second carrier and the first carrier are connected by a ring area that preferably surrounds the optoelectronic component of the second carrier. Therefore, a stable and robust mechanical connection between the first and the second area is provided. Despite the robust and stable connection between the first and the second carrier, the thermal conduction between the first and the second carrier is small.

In a further embodiment, a casing is arranged on the first carrier, wherein the casing is preferably also attached to the insulating layer. The mechanical connection between the insulating layer and the casing provides a stable connection between the casing and the first and the second carrier.

In a further embodiment, the insulating layer has a thermal conductivity that is lower than 0.1 W/mK. Any material with such a small thermal conductivity can be used for the insulating layer. Therefore, a lot of material or combinations of materials can be used for producing the insulating layer. Experiments have shown that a thermal conductivity smaller than 0.1 W/mK is sufficient to thermally insulate the first carrier from the second carrier.

Depending on the used embodiment, materials such as polyurethane with a thermal conductivity of about 0.02 W/mK, polystyrene with a thermal conductivity smaller than 0.03 W/mK, fiber glass with a thermal conductivity smaller than 0.03 W/mK, cork with a thermal conductivity smaller than 0.04 W/mK or perlite with a thermal conductivity smaller than 0.05 W/mK may be used as a material for the insulating layer.

In a further embodiment, the second carrier is attached to a heat sink that is provided for transporting the heat away from the second carrier.

In a further embodiment, a glue layer is arranged between the first layer and the insulating layer and/or a glue layer is arranged between the second layer and the insulating layer. Providing a glue layer improves the connecting force. Using a thermally insulating glue improves the thermal insulation between the first and the second carrier.

In a further embodiment, the insulating layer may have a thickness smaller than 0.5 mm. Experiments have shown that such a thickness is enough to sufficiently insulate the first carrier from the second layer.

BRIEF DESCRIPTION OF THE DRAWINGS

The accompanying drawings are included in order to provide a further understanding of the present invention and are incorporated into and constitute a part of this specification. The drawings illustrate embodiments of the present invention and together with the description serve to explain the principles of the invention. Other embodiments of the present invention and many of the intended advantages of the present invention will be readily appreciated as they will be better understood by reference to the following detailed description. The elements of the drawings are not to scale with regard to each other.

DETAILED DESCRIPTION OF ILLUSTRATIVE EMBODIMENTS

Figure 1:
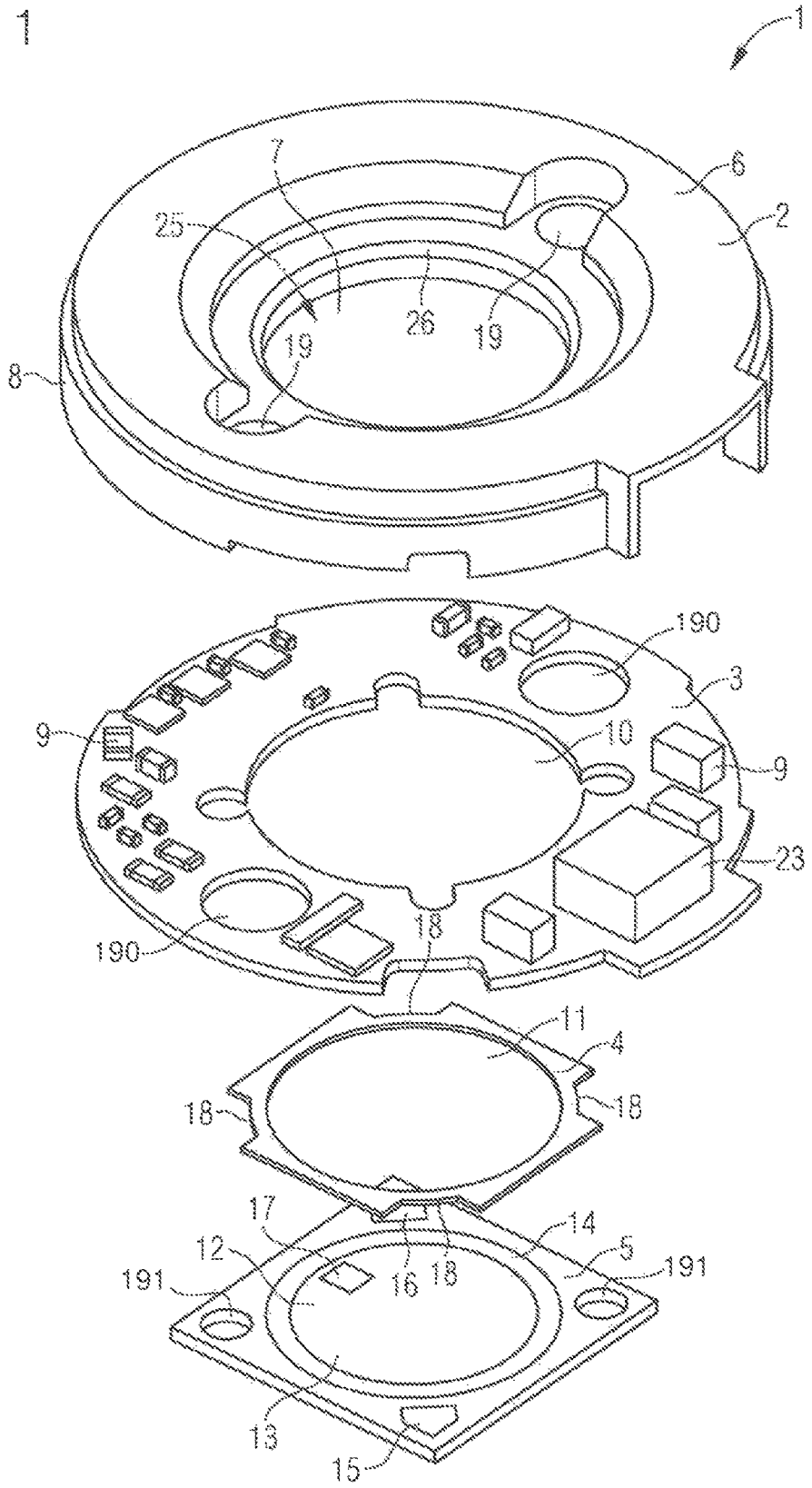
FIG. 1 shows main parts of a light apparatus in a schematic perspective view.

FIG. 1 shows main components of a light apparatus 1 with a casing 2, a first carrier 3, an insulating layer 4 and a second carrier 5 in an exploded view. The casing 2 comprises a circular disc 6 with a central light-emitting opening 7. The circular disc 6 is defined by two circular side walls 8, 26. The light-emitting opening 7 is covered by a glass plate 25, wherein the other part of the casing 2 may be made of plastic or metal. The casing 2 comprises screw holes 19.

Below the casing 2, the first carrier 3 is arranged. The first carrier 3 may comprise electronic components 9 for controlling an optoelectronic component. The electronic components 9 may be embodied as resistors, integrated circuits, capacitors and so on. The first carrier 3 has the shape of a circular ring plate with a central opening 10. The central opening 10 may have the same dimension as the light-emitting opening 7 of the casing 2. The first carrier 3 comprises at a lower side electric contacts that are provided for being connected with the first and the second contact 15, 16 of the second carrier 5. The first carrier 3 comprises a connector 23 that is used for connecting an electrical cable to the first carrier 1 for supplying electricity to the electronic components 9. The first carrier 3 may be made of FR-4 material. FR-4 is a composite material composed of woven fiber glass cloth with an epoxy resin binder that may be flame resistant. The first carrier 3 made of FR-4 material may have a thermal conductivity of about 0.52 W/mK.

Below the first carrier 3, the insulating layer 4 is depicted. The insulating layer 4 has a circular central area 11. Depending on the used embodiment, the insulating layer 4 may also be embodied in several pieces. For example, three or four pieces of the insulating layer 4 may be arranged around a central area 11. Three or four pieces of the insulating layer may be sufficient to provide a stable connection between the first carrier and the second carrier. Furthermore, the pieces of the insulating layer improve the thermal insulation between the first carrier and the second carrier. The circular central area 11 of the insulating layer 4 has the advantage that the handling is much easier and also the positioning of the insulating layer 4 during the mounting process is simpler compared to several pieces. The thickness of the insulating layer 4 may be smaller than 0.5 mm and preferably smaller than 0.2 mm. This thickness is sufficient to reduce or eliminate the transfer of heat from the second carrier 5 to the first carrier 3.

The insulating layer may have a thermal conductivity that is smaller than 0.1 W/mK. Any material with such a small thermal conductivity can be used for the insulating layer. The thermal conductivity that is smaller than 0.1 W/mK is sufficient to thermally insulate the first carrier from the second carrier.

Depending on the used embodiment, materials such as polyurethane with a thermal conductivity of about 0.02 W/mK, polystyrene with a thermal conductivity smaller than 0.03 W/mK, fiber glass with a thermal conductivity smaller than 0.03 W/mK, cork with a thermal conductivity smaller than 0.04 W/mK or perlite with a thermal conductivity smaller than 0.05 W/mK may be used as a material for the insulating layer.

The insulating layer 4 may comprise recesses 18 for providing free areas for the first and the second contact 15, 16 for being contacted with the corresponding contacts of the first carrier 3 and/or for providing space for fixing means such as, for example, screws that are used for fixing the second carrier 5, the first carrier 3 to the casing 2.

Below the insulating layer 4, the second carrier 5 is depicted. The second carrier 5 in the shown embodiment has a rectangular shape with a central light-emitting area 12. In the light-emitting area 12, an optoelectronic component 17, for example, a light-emitting diode or a laser diode is arranged. Depending on the used embodiment, several light-emitting optoelectronic components 17 are arranged. The optoelectronic components may be covered by a cover layer 13 as shown in FIG. 1. The cover layer 13 may comprise material for changing the wavelength of the electromagnetic radiation that is emitted by the optoelectronic component 17. For example, phosphor is used as material for changing the wavelength of the electromagnetic radiation. Furthermore, the cover layer 13 may comprise particles for scattering the electromagnetic radiation of the optoelectronic component 17.

The light-emitting area 12 is surrounded by a rim 14. The second carrier 5 comprises a first and a second electric contact 15, 16 that is used for electrically connecting the optoelectronic component 17 of the second carrier 5 with the electronic component 9 of the first carrier 3. The central area 11 of the insulating layer 4 may at least comprise the same dimension and shape as the light-emitting area 12 of the second carrier 5.

The first carrier 3 represents a control module for controlling the optoelectronic component 17 of the second carrier 5. Depending on the used embodiment, the second carrier 5 may also comprise at least one electronic component for controlling the optoelectronic component 17. The first and the second carrier 3, 5 may be embodied as a printed circuit board or as a ceramic plate. The first and the second carrier 3, 5 may also comprise screw holes 190, 191.

Figure 2:
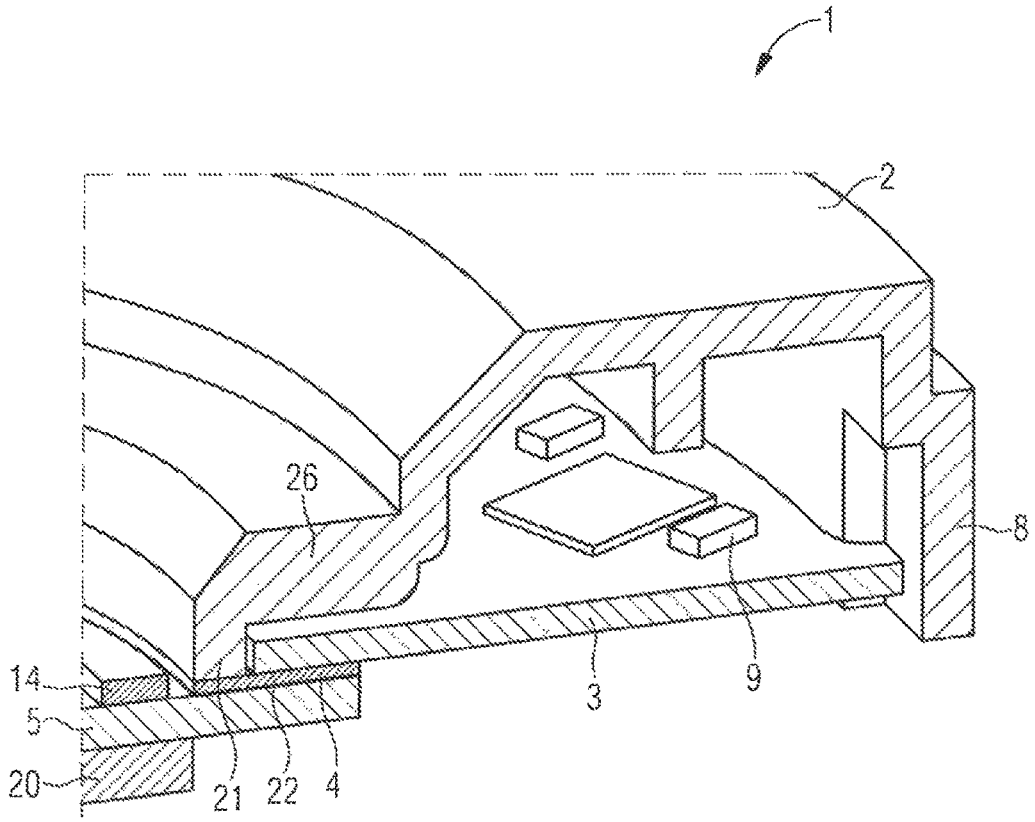
FIG. 2 shows a part of a cross-section of the light apparatus in a partial cross-sectional view.

FIG. 2 shows the light apparatus 1 in a partial cross-sectional view in a mounted position. The first carrier 3 is arranged within the casing 2 between the two side walls 8, 26. The casing 2 comprises an inner rim 21 at the second wall 26 that bears on the insulating layer 4. The insulating layer 4 bears on an upper side at an outer rim area of the second carrier 5. Depending on the used embodiment, the inner rim 21 of the casing 2 may bear directly on an upper face of the second carrier 5. The insulating layer 4 is arranged between the first carrier 3 and the second carrier 5. Depending on the used embodiment, a glue layer 22 may be arranged between the second carrier 5 and the insulating layer 4 and/or between the first carrier 3 and the insulating layer 4. Furthermore, in the shown embodiment the insulating layer 4 is preferably also arranged between the second carrier 5 and the casing 2, especially the inner rim 21 of the casing 2.

Additionally, depending on the used embodiment, the second carrier 5 is in contact with a heat sink 20 that may be embodied as a metal plate or any other material that is thermally conducting. The heat sink 20 improves the transport of the heat out of the casing 2. The heat sink 20 may deliver the heat to the environment; that means the ambient air.

While the invention has been described in detail with reference to specific embodiments thereof, it will be apparent to one of ordinary skill in the art that various changes and modifications can be made therein without departing from the spirit and scope thereof. Accordingly, it is intended that the present invention covers the modifications and variations of this invention provided they come within the scope of the appended claims and their equivalents.

The invention claimed is:

1. A light apparatus comprising:

a first carrier having a shape of a circular ring plate with a central opening;

a second carrier;

an optoelectronic component for generating electromagnetic radiation, the optoelectronic component attached to the second carrier;

at least one electronic component for controlling the optoelectronic component, the at least one electronic component attached to the first carrier;

a thermally insulating layer arranged between the first and second carriers, wherein the first and second carriers are attached to the insulating layer, wherein the insulating layer has a circular shape, wherein the insulating layer comprises several pieces or one ring shape, wherein the insulating layer is arranged around a central area, wherein the optoelectronic component is arranged in the central area, and wherein the insulating layer surrounds the optoelectronic component; and a casing comprising a circular disc with a central light-emitting opening, wherein the circular disc is defined by two circular side walls, wherein the first carrier is arranged within the casing between the two side walls, wherein the casing comprises an inner rim at the second side wall, and wherein the inner rim bears on the insulating layer.

2. The apparatus of claim 1, wherein the casing is arranged on the first carrier and covers the first carrier, and wherein the casing is attached to the insulating layer.

3. The apparatus of claim 1, wherein the insulating layer has a thermal conductivity that is lower than 0.1 W/mK.

4. The apparatus of claim 1, further comprising a heat sink that is in contact with the second carrier.

5. The apparatus of claim 1, further comprising a glue layer arranged between the first carrier and the insulating layer.

6. The apparatus of claim 1, wherein the insulating layer has a thickness smaller than 0.5 mm.

7. The apparatus of claim 1, wherein the second carrier comprises a first electric contact and a second electric contact configured to electrically connect the optoelectronic component of the second carrier with the electronic component of the first carrier, and wherein the insulating layer comprises recesses for providing free areas for the first and second contacts.

8. The apparatus of claim 1, wherein the second carrier has a rectangular shape with a central light-emitting area, wherein the optoelectronic component is arranged in the light-emitting area, and wherein the light-emitting area is surrounded by a rim.

9. The apparatus of claim 1, further comprising a glue layer arranged between the second carrier and the insulating layer.

10. A light apparatus comprising:

a first carrier having a shape of a circular ring plate with a central opening;

a second carrier;

an optoelectronic component for generating electromagnetic radiation, the optoelectronic component attached to the second carrier;

at least one electronic component for controlling the optoelectronic component, the at least one electronic component attached to the first carrier;

a thermally insulating layer arranged between the first and second carriers, wherein the first and second carriers are attached to the insulating layer, wherein the insulating layer has a circular shape, wherein the insulating layer comprises several pieces or one ring shape, wherein the insulating layer is arranged around a central area, wherein the optoelectronic component is arranged in the central area, and wherein the insulating layer surrounds the optoelectronic component; and a casing comprising a circular disc with a central light-emitting opening, wherein the circular disc is defined by two circular side walls, wherein the first carrier is arranged within the casing between the two side walls, wherein the casing comprises an inner rim at the second side wall, and wherein the inner rim of the casing bears directly on an upper face of the second carrier.

11. The apparatus of claim 10, wherein the casing is arranged on the first carrier and covers the first carrier, and wherein the casing is attached to the insulating layer.

12. The apparatus of claim 10, wherein the insulating layer has a thermal conductivity that is lower than 0.1 W/mK.

13. The apparatus of claim 10, further comprising a heat sink that is in contact with the second carrier.

14. The apparatus of claim 10, further comprising a glue layer arranged between the first carrier and the insulating layer.

15. The apparatus of claim 10, wherein the insulating layer has a thickness smaller than 0.5 mm.

16. The apparatus of claim 10, wherein the second carrier comprises a first electric contact and a second electric contact configured to electrically connect the optoelectronic component of the second carrier with the electronic component of the first carrier, and wherein the insulating layer comprises recesses for providing free areas for the first and second contacts.

17. The apparatus of claim 10, wherein the second carrier has a rectangular shape with a central light-emitting area, wherein the optoelectronic component is arranged in the light-emitting area, and wherein the light-emitting area is surrounded by a rim.

18. The apparatus of claim 10, wherein the insulating layer surrounds the inner rim and bears on an upper side at an outer rim area of the second carrier.

19. The apparatus of claim 10, further comprising a glue layer arranged between the second carrier and the insulating layer.

* * * * *